US010086378B2

(12) United States Patent
Okuya

(10) Patent No.: US 10,086,378 B2
(45) Date of Patent: Oct. 2, 2018

(54) BLADE PLATE FOR CRUSHER AND CRUSHER

(71) Applicant: YUATSUKI Co., Ltd., Aichi (JP)

(72) Inventor: Yasuaki Okuya, Aichi (JP)

(73) Assignee: YUATSUKI Co., Ltd., Aichi (JP)

( * ) Notice: Subject to any disclaimer, the term of this patent is extended or adjusted under 35 U.S.C. 154(b) by 0 days.

(21) Appl. No.: 15/027,267

(22) PCT Filed: Aug. 5, 2015

(86) PCT No.: PCT/JP2015/072200
§ 371 (c)(1),
(2) Date: Apr. 5, 2016

(87) PCT Pub. No.: WO2016/181574
PCT Pub. Date: Nov. 17, 2016

(65) Prior Publication Data

US 2018/0050340 A1 Feb. 22, 2018

(30) Foreign Application Priority Data

May 10, 2015 (JP) ..... 2015-096129

(51) Int. Cl.
*B02C 1/04* (2006.01)
*B02C 1/10* (2006.01)

(52) U.S. Cl.
CPC . *B02C 1/10* (2013.01); *B02C 1/04* (2013.01)

(58) Field of Classification Search
CPC ..... B02C 1/04; B02C 1/10
USPC ..... 241/264
See application file for complete search history.

(56) References Cited

U.S. PATENT DOCUMENTS 2,296,088 A * 9/1942 Carter ..... A23N 5/00 100/215
2,843,331 A * 7/1958 Reeves ..... B02C 1/10 241/198.1
6,145,768 A * 11/2000 Okuya ..... B02C 1/005 241/265
6,764,036 B2 * 7/2004 Okuya ..... B02C 1/005 241/264
7,086,620 B2 * 8/2006 Okuya ..... B02C 1/025 241/264

(Continued)

FOREIGN PATENT DOCUMENTS

JP 61-032351 2/1986
JP 06-106083 4/1994
JP 3330083 9/2002

(Continued)

*Primary Examiner* — Faye Francis
(74) *Attorney, Agent, or Firm* — Clark & Brody

(57) ABSTRACT

A blade plate for crushers to be installed on a fixed side or a moving side, includes a base material part and many blade parts arranged on the surface of the base material part. The blade part includes a diamond blade part having an edge formed of a corner between a belt-like part and an inclined part, and a chevron blade part which is configured in a polyhedral shape having an edge formed of a corner between a cross-shaped tip end belt-like part and a foot part and an edge formed of a corner between an inclined belt-like part and a foot part, and which is bound to an intersection place of the diagonal lines of the diamond blade part. Also provided is a crusher which utilizes the blade plate.

14 Claims, 10 Drawing Sheets

(56) References Cited

U.S. PATENT DOCUMENTS

| | | | | |
|---|---|---|---|---|
| 8,262,007 | B2 * | 9/2012 | Okuya | B02C 1/10<br>241/264 |
| 8,851,407 | B2 * | 10/2014 | Okuya | B02C 1/04<br>241/101.73 |

FOREIGN PATENT DOCUMENTS

| | | |
|---|---|---|
| JP | 2002-361402 | 12/2002 |
| JP | 2005-087915 | 4/2005 |
| JP | 4885478 | 2/2012 |
| JP | 2012-040514 | 3/2012 |
| JP | 5748323 | 7/2015 |
| WO | 2012/023632 | 2/2012 |

* cited by examiner

BLADE PLATE FOR CRUSHER AND CRUSHER

TECHNICAL FIELD

The present invention relates to a blade plate (a fixed blade plate or a moving blade plate) for crushers, which is intended to crush materials to be crushed, and also relates to a crusher.

BACKGROUND ART

Crushers for crushing materials to be crushed such as unnecessary cast product, sprue, runner and ingate have been conventionally known. In the case where these unnecessary materials to be crushed are crushed, crushers are convenient also, for example, in storing, transporting and treating the waste after crushing if they can finely crush the materials. Therefore, blades, which are used in crushers, are especially important in order to realize efficient crushing of the materials to be crushed. For example, Document 1, which will be described below, is indicated as one example of documents regarding crushers for crushing unnecessary materials to be crushed.

PRIOR ART DOCUMENT

Patent Document

Document 1 relates to "a hydraulic crushing and breaking device for ingate, runner and defective product for casting" including:

a frame which having front and rear open surfaces;

a fixed blade device which is provided on this frame and has many chevron blades projectingly provided in a zigzag form;

a freely-oscillatable oscillating blade device which is opposed to this fixed blade device and has many chevron blades having a fitting relation with chevron blades having a pivoting part in the lower part of the frame;

a pressing means such as a cylinder for oscillating this oscillating blade device; and a discharge port for discharging crushed and broken casting pieces, which is provided on the lower side of the oscillating blade device and fixed blade device.

[Patent Document 1] JP 06-106083 A

SUMMARY OF THE INVENTION

Problem to be Solved by the Invention

However, the invention disclosed in Document 1 is intended to crush and break an ingate, a runner and a defective product for casting by fitting between the chevron blades of the fixed blade device and the chevron blades of the oscillating blade device which faces this fixed blade device, and involves, so called, "face" contact with the material to be crushed, which is a target object to be contacted. Thus, the cited invention does not involve contact at the belt-like part and edge which will be described later, i.e., so called, "line" contact as in the present invention, thereby making the stress concentration hard to act on unnecessary cast products, so that the crushed ingate, runner and defective product are not finely crushed in some cases.

Means for Solving the Problem

An object of the present invention is to provide a blade plate for crushers wherein a diamond blade part arranged on the surface of a base material part and having an edge formed of a corner between a belt-like part and an inclined part is brought in, so called, "line" or "point" contact, for example, with a chevron blade part having an edge formed of a corner between a tip end belt-like part and a foot part and an edge formed of a corner between an inclined belt-like part and a foot part, etc., so that stress concentration is caused in materials to be crushed, which are unnecessary cast products to be broken, thereby finely crushing the materials to be crushed, and is also to provide a crusher which uses this blade plate.

The invention relates to a blade plate for crushers to be installed on a fixed side or a moving side, including a base material part and many blade parts arranged on the surface of this base material part, wherein this blade part includes:

a diamond blade part having an edge formed of a corner between a belt-like part and an inclined part; and a chevron blade part which is configured in a polyhedral shape having an edge formed of a corner between a cross-shaped tip end belt-like part and a foot part and an edge formed of a corner between an inclined belt-like part and a foot part, and which is bound to an intersection place of the diagonal lines of the diamond blade part.

The invention relates to a blade plate for crushers to be installed on a fixed side (fixed blade plate), including a base material part and many blade parts arranged on the surface of this base material part, wherein this blade part includes:

a concave blade part arranged on the upper side of the base material part;

a diamond blade part arranged on the lower side of this concave blade part and having an edge formed of a corner between a belt-like part and an inclined part;

a chevron blade part which is configured in a polyhedral shape having an edge formed of a corner between a cross-shaped tip end belt-like part and a foot part and an edge formed of a corner between an inclined belt-like part and a foot part, and which is bound to an intersection place of the diagonal lines of the diamond blade part; and a convex blade part having an edge formed of a corner between a belt-like part and an inclined part, the convex blade part being connected to a part of the chevron blade arranged on the lowermost stage of the base material part.

The invention relates to the blade plate for crushers to be installed on a fixed side (fixed blade plate), wherein the concave blade part forms a recess in the base material part, and is formed in an opening shape such that a vertical blade and a lateral blade are combined in this recess, and wherein the left inner surface, right inner surface and lower inner surface of the concave blade part are inclined toward the deep side so that the upper inner surface is vertical to the base material part.

The invention relates to a blade plate for crushers to be installed on a moving side (moving blade plate), including a base material part and many blade parts arranged on the surface of this base material part, wherein this blade part includes:

a concave blade part arranged on the upper side of the base material part;

a diamond blade part arranged on the lower side of this concave blade part and having an edge formed of a corner between a belt-like part and an inclined part;

a chevron blade part which is configured in a polyhedral shape having an edge formed of a corner between a cross-shaped tip end belt-like part and a foot part and an edge formed of a corner between an inclined belt-like part and a foot part, and which is bound to an intersection place of the diagonal lines of the diamond blade part;

a convex blade part having an edge formed of a corner between a belt-like part and an inclined part, the convex blade part being connected to a part of the chevron blade arranged on the lowermost stage of the base material part, and small blade parts including halved triangular pyramids which are vertically connected, the small blade parts being located on both sides of this convex blade part.

The invention relates to the blade plate for crushers to be installed on a moving side (moving blade plate), wherein the small blade parts have an edge formed of a corner between a belt-like part and an inclined part.

The invention relates to the blade plate for crushers to be installed on a moving side (moving blade plate), wherein the concave blade part forms a recess in the base material part, and is in an opening shape in which a vertical blade and a lateral blade are combined in a lattice shape in this recess, and wherein the left inner surface, right inner surface and lower inner surface of the concave blade part are inclined toward the deep side so that the upper inner surface is vertical to the base material part.

The invention relates to the blade plate for crushers to be installed on a moving side (moving blade plate), wherein the convex blade part has one or two or more notch part(s).

The invention relates to the blade plate for crushers to be installed on a fixed side or a moving side, wherein the materials for the base material part and the blade parts are high manganese cast steel, and wherein at least any one of the top surface, rear surface, flat surface, bottom surface and side surface of the base material part is provided with a bolt hole through which a bolt is screwed and inserted.

The invention relates to the blade plate for crushers to be installed on a fixed side or a moving side, wherein the belt-like part of the diamond blade part, the tip end belt-like part and the inclined belt-like part of the chevron blade part, the belt-like part of the convex blade part and the belt-like part of the small blade parts have a width of 5 mm to 15 mm.

The invention relates to the blade plate for crushers to be installed on a fixed side or a moving side, wherein the angle θ between the inclined belt-like parts of the chevron parts arranged on the base material part is 90° or higher.

The invention relates to a crusher including:

a vertically-opening frame which is composed of a pair of side frames provided in juxtaposition, a front frame connecting the front sides of both the side frames, and a rear frame connecting the rear sides of both the side frames, and which has an upper opening part for injecting a material to be crushed and a lower opening part for discharging the crushed material;

a fixed blade plate which is fixed and supported on a holder provided vertically or slantly to the frame; and a moving blade plate which is axially supported on a fulcrum shaft constructed between both the side frames, is inclined to the frame at a backward movement limit position, becomes vertical to the frame at a forward movement limit position, and moves forward and backward using the fulcrum shaft as a fulcrum in accordance with the forward and backward movement of the piston rod of a cylinder provided on the rear frame, wherein the material to be crushed is supplied to a V-shaped crushing space formed between the fixed blade plate and the moving blade plate, and is crushed upon forward movement of the moving blade plate to the fixed blade plate, and wherein the blade plate is used as the fixed blade plate and/or the moving blade plate.

The invention relates to a crusher including:

a vertically-opening frame which is composed of a pair of side frames provided in juxtaposition, a front frame connecting the front sides of both the side frames, and a rear frame connecting the rear sides of both the side frames, and which has an upper opening part for injecting a material to be crushed and a lower opening part for discharging the crushed material;

a fixed blade plate which is fixed and supported on a holder provided vertically or slantly to the frame; and a moving blade plate which is axially supported on a fulcrum shaft constructed between both the side frames, is inclined to the frame at a backward movement limit position, becomes vertical to the frame at a forward movement limit position, and moves forward and backward using the fulcrum shaft as a fulcrum in accordance with the forward and backward movement of the piston rod of a cylinder provided on the rear frame, wherein the material to be crushed is supplied to a V-shaped crushing space formed between the fixed blade plate and the moving blade plate, and is crushed upon forward movement of the moving blade plate to the fixed blade plate, wherein the fixed blade plate is used as the fixed blade plate, and wherein the moving blade plate is used as the moving blade plate.

The invention as claimed in claim 13 relates to the crusher, wherein both the side frames further include a liner having abrasion resistance on the inside thereof.

The invention as claimed in claim 14 relates to the crusher, wherein the holder includes an upper part and a lower part, and the lower part has a discharge lower end extending frontward and also a receiving blade having an inclined surface from the upper side toward the lower side.

Effect of the Invention

According to the inventions, the diamond blade part, chevron blade part and the like are arranged on the surface of the base material part of the blade plate; the diamond blade part has an edge formed of a corner between a belt-like part and an inclined part; and the chevron blade part has an edge formed of a corner between a cross-shaped tip end belt-like part and a foot part and an edge formed of a corner between an inclined belt-like part and a foot part. Therefore, the respective belt-like parts, respective inclined belt-like parts, tip end belt-like part and respective edges are brought in, so called, "line" or "point" contact with the material to be crushed, which is a target object to be contacted, thereby causing stress concentration in the material to be crushed, which is an unnecessary cast product to be crushed, so that the material to be crushed can be finely crushed (cut, broken, ground, smashed, split, etc.). Thus, for example, in such a case where a crushed waste made of an iron material is sucked by the magnetic force of a magnet lifter and transported, if the material to be crushed can be finely crushed, the finely-crushed waste can be sucked in large quantities by using a magnet lifter and transported. Therefore, the waste is conveniently transported. Also, the crushed waste, when stored in a basket for storage, can be put therein with almost no gap, thereby making it possible to increase the density within the storing basket, resulting in convenient storage, transport and the like, improved working efficiency, and, further, utilization of a factory yard in a spacious manner. Also, when the crushed waste is molten, for example, in an electric furnace, the melting speed becomes faster due to the finely-crushed waste, thereby making it possible to suppress the power consumption (kwh) during melting, and thus to reduce the costs for melting and operations.

Also, the lifetime of the edges can be prolonged by virtue of the respective belt-like parts, respective inclined belt-like parts and tip end belt-like part.

The material to be crushed can be effectively roughly split by the concave blade part arranged on the upper side of the base material part.

The convex blade part arranged on the moving blade plate and small blade parts arranged on both sides of the convex blade part enable effective crushing of the material to be crashed and discharge of the crushed waste, due to the single effects of these parts or synergistic effects thereof.

The fixed blade plate and the moving blade plate are brought in line or point contact at a plurality of places with the materials to be crushed, so that the materials are finely crushed. The materials can be crushed into a size as a raw material for the product, and thus can be, so called, "productized."

According to the invention, one or two or more notch part(s) provided in the convex blade part arranged in the moving blade plate facilitate(s) effective crushing of the material to be crushed and discharge of the crushed waste.

According to the invention, high manganese cast steel having high hardness and toughness is used as the materials for the base material part and the blade parts, and thus it is possible to provide a blade plate which is work-hardened each time it is used, and which has excellent abrasion resistance and impact abrasion resistance.

Conventional blade plates require maintenance at constant intervals, but the blade plate made of high manganese cast steel according to the present invention increases its hardness and toughness as it is used more, and thus is maintenance-free for about several years to several decades or longer.

Also, the base material part made of high manganese cast steel has been subjected to bolt hole processing. Therefore, a bolt hole portion is work-hardened as the blade plate is used more, so that the bolt hole has higher strength and does not loosen, thereby making it possible to improve the blade plate attachment accuracy and performance.

The hardness of the blade plate is increased, thereby making it possible to decrease the replacement frequency due to prolonged lifetime of the blade plate and to reduce the labor required for replacement operation.

According to the invention, the widths of the belt-like part, tip end belt-like part, inclined belt-like part, and belt-like parts of the convex blade part and small blade parts are defined as 5 mm to 15 mm, thereby making it possible to efficiently cause stress concentration in the material to be crushed and broken to finely crush the material to be crushed, and also to prolong the lifetime of the edges.

According to the invention, the angle θ between the inclined belt-like parts of the foot parts of the chevron parts arranged on the base material part is defined as 90° or higher, thereby making the material hard to be fitted between the inclined belt-like parts so that the material to be crushed and crushed waste easily fall.

According to the inventions, the crusher using the blade plate having the effects of the inventions can be used to efficiently crush the material, thereby improving the operation rate of the crusher.

MODES FOR CARRYING OUT THE INVENTION

Figure 1:
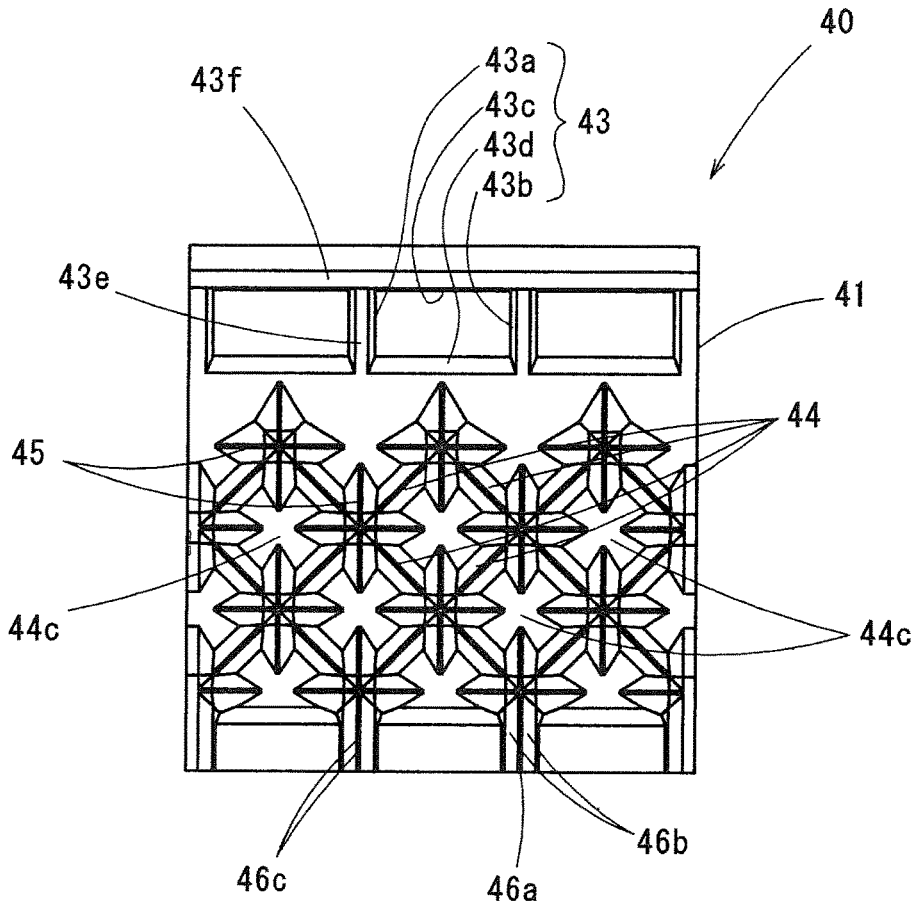
FIG. 1 is a front view of a fixed blade plate.
Figure 3:
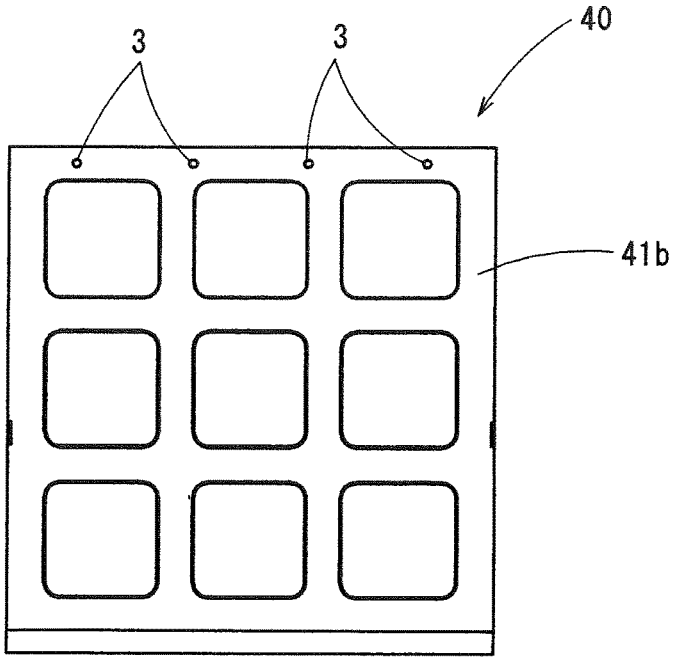
FIG. 3 is a back view of the fixed blade plate.

Modes for carrying out the present invention will be illustrated below.

The present invention relates to a blade plate for a crusher Y which can finely crush a material X to be crushed, such as unnecessary cast product, sprue, runner and ingate, and also relates to the crusher Y in which this blade plate is arranged. This blade plate can be a fixed blade plate 40 for fixation, which is installed on the fixed side of the crusher Y or a moving blade plate 50 for movement, which is installed on the moving side of the crusher Y. This blade plate is configured to crush the material X to be crushed by means of many blade parts 42 arranged on a top surface 41*a* which is a crushing surface of a base material part 41 of the fixed blade late 40 and many blade parts 52 arranged on a top surface 51*a* which is a crushing surface of a base material part 51 of the moving blade plate 50.

Also, the blade plate is characterized, for example, in that the base material part 41, 51 and blade part 42, 52 of the blade plate are made of high manganese steel, and that the base material part 41, 51 of the blade plate is provided with a bolt hole 3 (female screw hole) through which a bolt for attachment of the blade plate is screwed and inserted.

The shapes of such many blade parts 42, 52 arranged on the top surface 41*a*, 51*a* of the fixed blade plate 40 and the moving blade plate 50 will be explained based on the respective drawings.

First, a blade part 42 of the fixed blade plate 40 is shown mainly in FIGS. 1 to 4, etc., and a blade part 52 of the moving blade plate 50 is shown mainly in FIGS. 5 to 8.

Hereinafter, the fixed blade plate 40 shown in FIGS. 1 to 4, etc. will be explained.

A substantially rectangular concave blade part 43 is arranged on the upper side of the base material part 41 of the fixed blade plate 40. Also, there are arranged: a diamond blade part 44 provided on the lower side of this concave blade part 43 and having an edge (blade edge) 44*d* formed of a corner between a belt-like part 44*a* and an inclined part 44*b*; a chevron blade part 45 which is configured in a polyhedral shape having an edge (blade edge) 45*b*3 formed of a corner between a cross-shaped tip end belt-like part 45*a* and a foot part 45*b* and an edge (blade edge) 45*b*4 formed of a corner between an inclined belt-like part 45*b*1 and a foot part 45*b*2, and which is bound to an intersection place of the diagonal lines of the diamond blade part 44; and further a convex blade part 46 having an edge (blade edge) 46*c* formed of a corner between a belt-like part 46*a* and an inclined part 46*b*, the convex blade part 46 being connected to a part of the chevron blade 45 arranged on the lowermost stage of the base material part 41.

The concave blade part 43 mainly forms a recess in the base material part 41, and is formed in an opening shape such that a vertical blade 43*e* and a lateral blade 43*f* are combined in this recess, and the left inner surface 43*a*, right inner surface 43*b* and lower inner surface 43*d* of the concave blade part 43 in a front view are inclined toward the deep side so that the upper inner surface 43*c* is vertical to the base material part 41. Also, the concave blade part 43 may be configured so that the upper inner surface 43*c* is inclined downward. In other words, the concave blade part 43 may be configured in any manner so long as the material X to be crushed is hard to escape upward during crushing. In the meantime, three substantially rectangular concave blade parts 43 are continuously provided in FIG. 1 and the like, but the number, size and the like of the concave blade parts 43 are not especially limited. Thus, for example, a plurality of vertical blades 43*e* and a plurality of lateral blades 43*f* may be combined in a lattice shape in this recess so as to form, for example, six concave blade parts 43.

Figure 2:
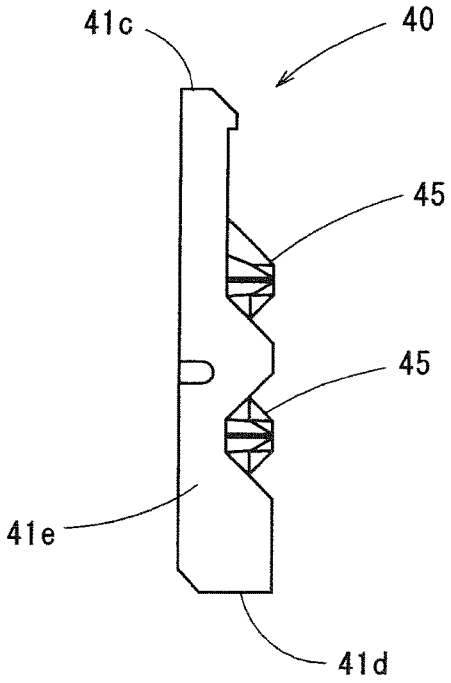
FIG. 2 is a side view of the fixed blade plate.
Figure 4:
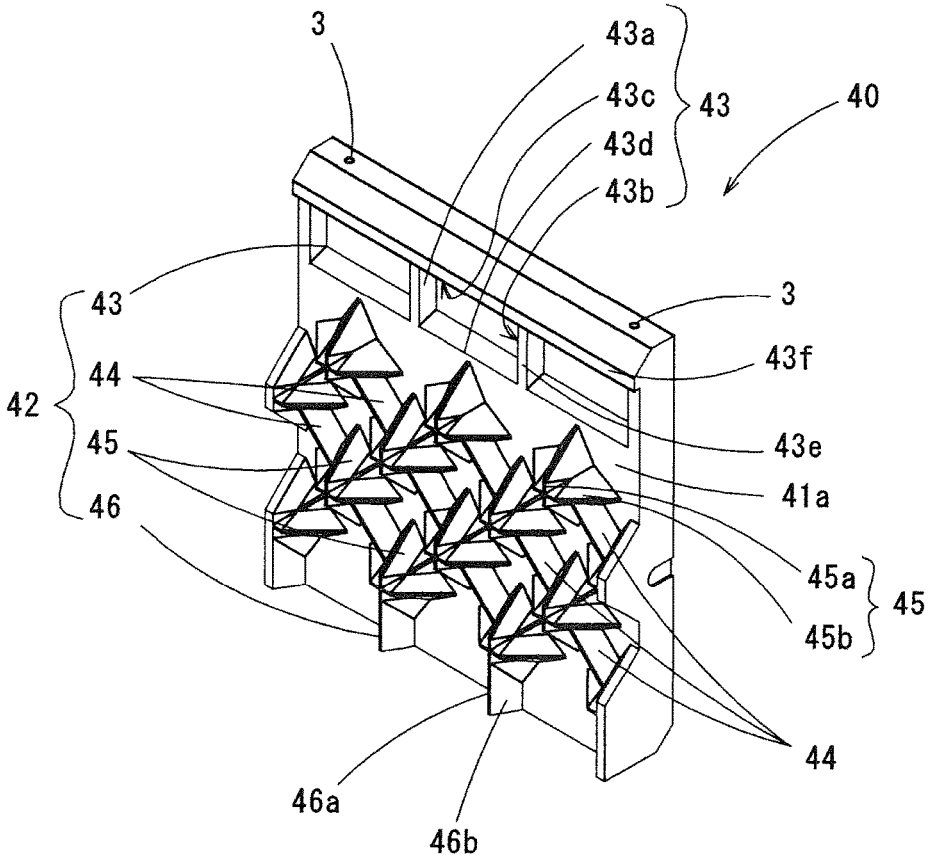
FIG. 4 is a perspective view of the fixed blade plate.
Figure 5:
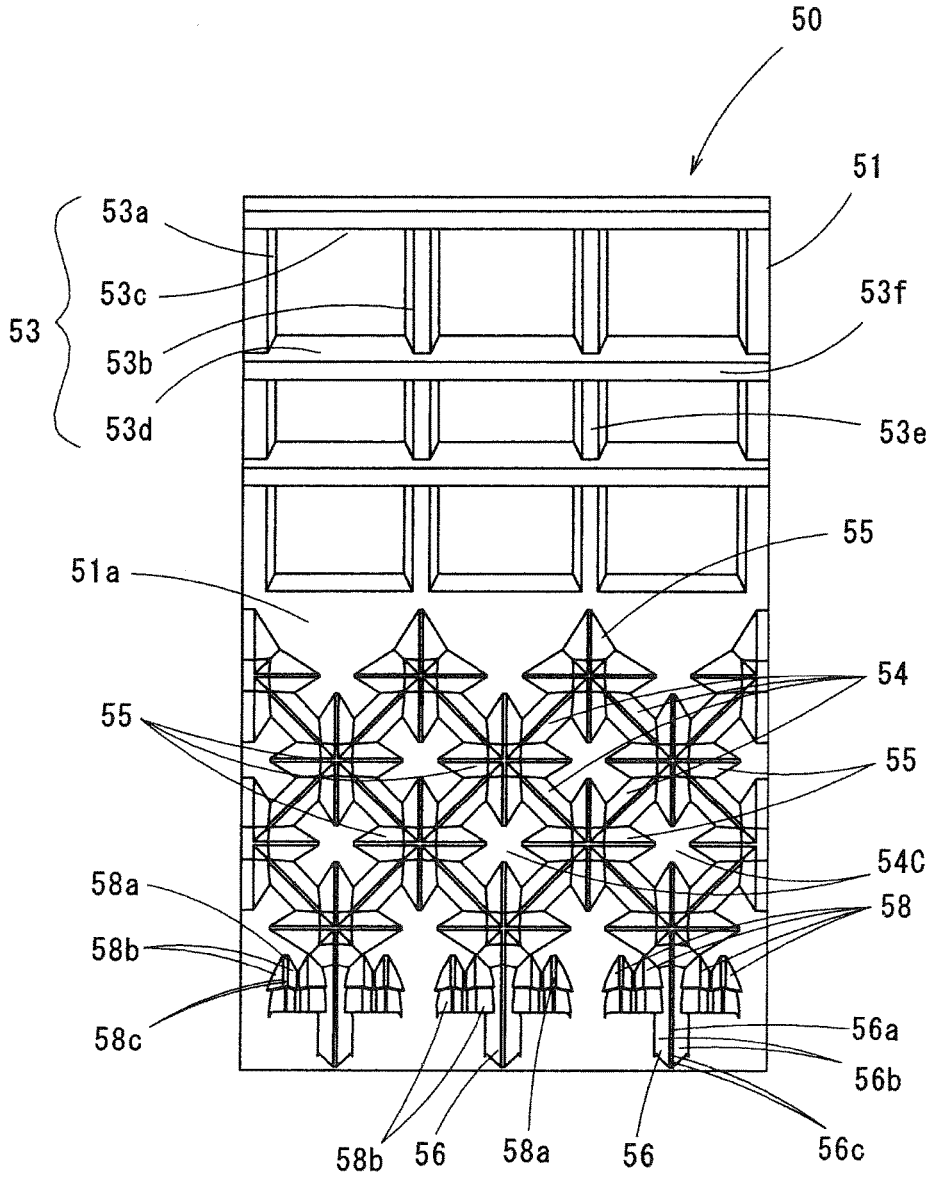
FIG. 5 is a front view of a moving blade plate.
Figure 6:
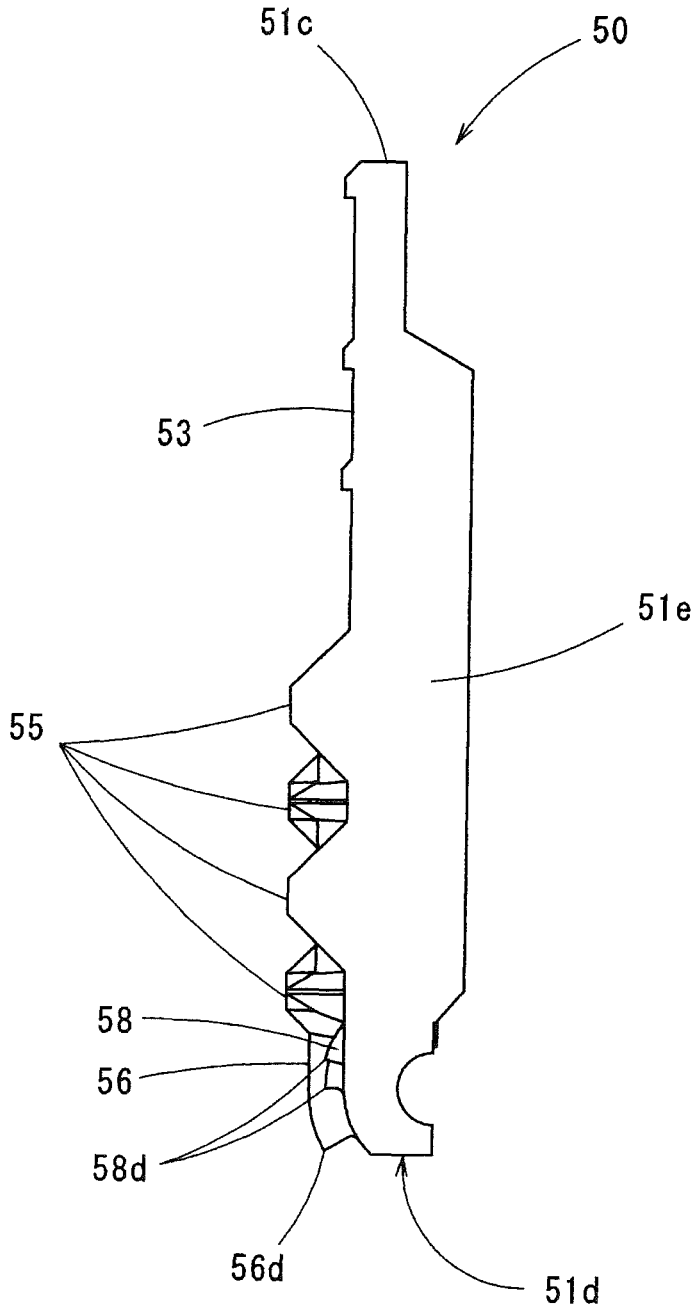
FIG. 6 is a side view of the moving blade plate.

While the lateral blade 43*f* extends farther than the vertical blade 43*e* in FIGS. 2 and 4, there may be employed either a configuration such that the vertical blade 43*e* extends farther than the lateral blade 43*f* or a configuration such that the vertical blade 43*e* and the lateral blade 43*f* are at the same level. Also, the lateral blade 43*f* can extend farther than that as shown in FIGS. 2 and 4.

The diamond blade part 44 arranged on the lower side of this concave blade part 43 will now be explained.

This diamond blade part 44 is literally arranged in a diamond shape on the top surface 41*a* of the base material part 41, and the respective sides of the diamond consist of the belt-like part 44*a* and the inclined part 44*b*. Specifically, this part is in a substantially trapezoidal shape, in a cross sectional view, in which inclined parts 44*b* are formed from the belt-like part 44*a* toward both sides.

The corner between the belt-like part 44*a* and the inclined part 44*b* is used as an edge 44*d*, thereby making it possible to finely crush the material X to be crushed. In the meantime, this belt-like part 44*a* can also be a curved surface.

Figure 11:
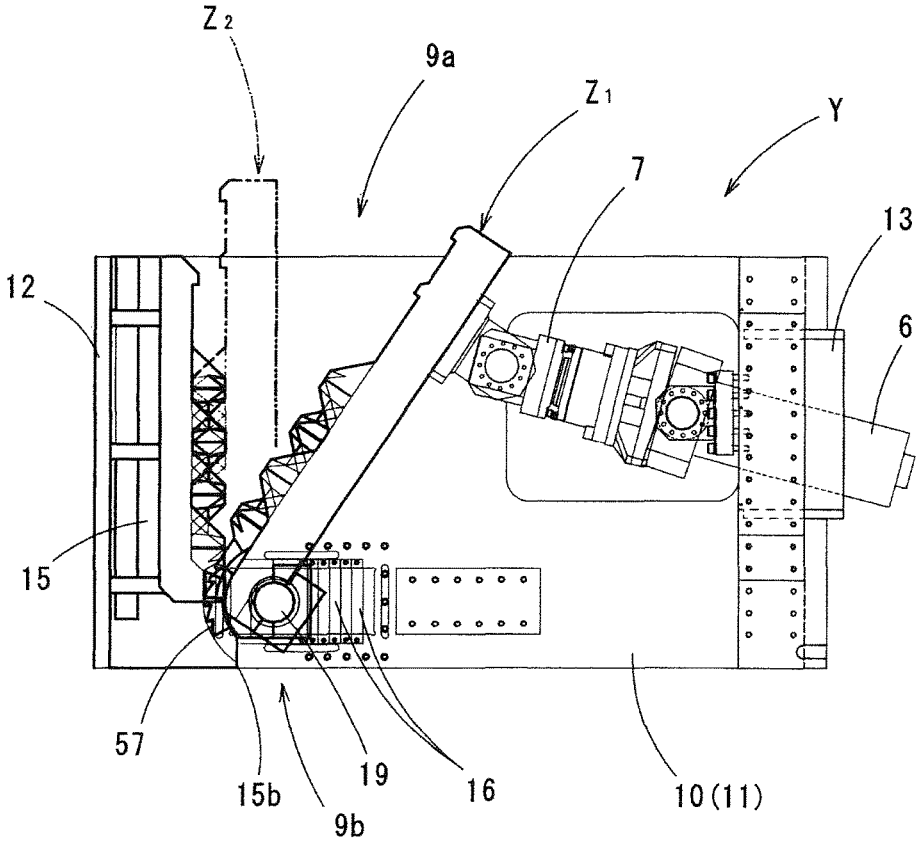
FIG. 11 is a side view of a crusher provided with the fixed blade plate shown in FIG. 1 and the moving blade plate shown in FIG. 5 in a state where the moving blade plate is moved forward and backward.
Figure 12:
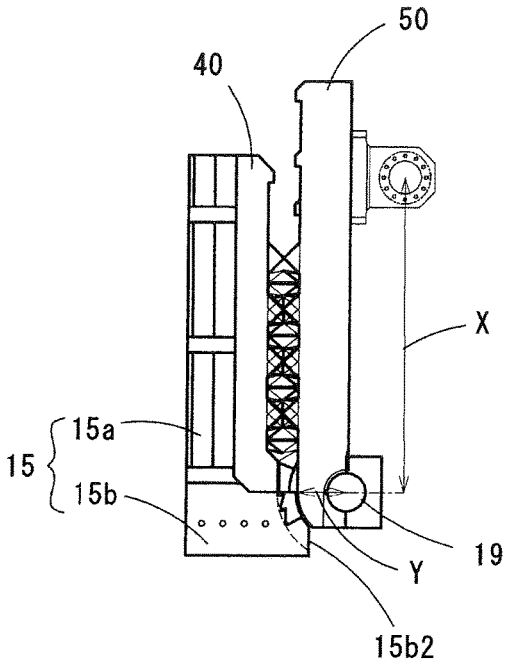
FIG. 12 is a side view showing the fixed blade plate and the moving blade plate in a state where the moving blade plate has been moved forward to a forward movement limit position.
Figure 13:
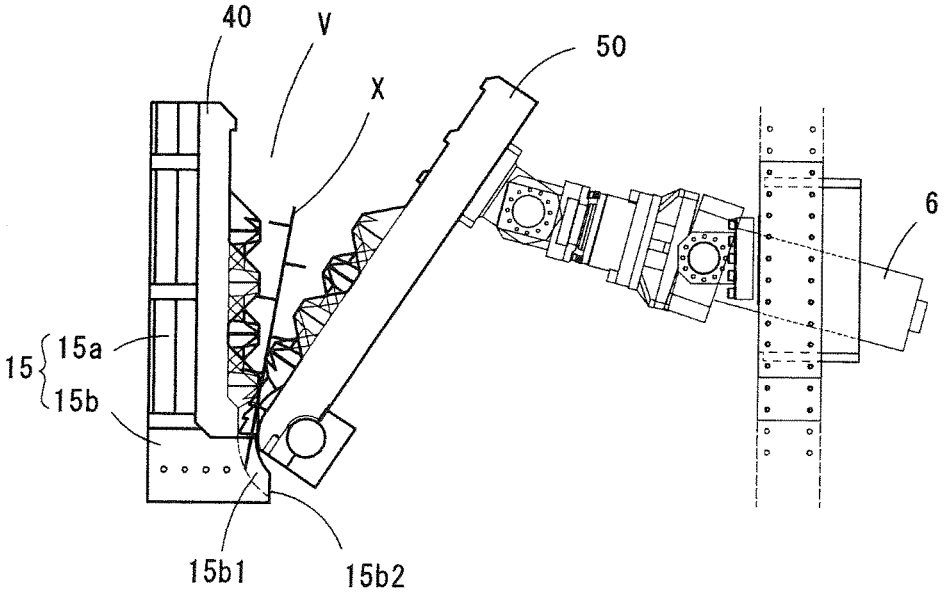
FIG. 13 is a side view showing a state where a material to be crushed is caught by a receiving blade.

The region enclosed by the four sides of the diamond blade part 44, 54 of the fixed blade plate 40 or the moving blade plate 50 which will be described later is defined as a fitting region 44*c*, 54*c*. For example, when the fixed blade plate 40 is arranged vertically to a frame 9, the number of supporting blocks 16 is adjusted so that the position of a fulcrum shaft 19 is close to a front frame 12, and the moving blade plate 50 moves forward up to a forward movement limit position Z2 toward the side of the fixed blade plate 40, the chevron blade parts 55 and 45 can be arranged to be mutually fitted in the fitting regions 44*c* and 54*c*, respectively, of the fixed blade plate 40 and moving blade plate 50. Specifically, the chevron blade part 55 of the moving blade plate 50 is arranged to be fitted in the fitting region 44*c* enclosed by the four sides of the diamond blade part 44, and the chevron blade part 45 of the fixed blade plate 40 is arranged to be fitted in the fitting region 54*c* enclosed by the four sides of the diamond blade part 54 of the moving blade plate 50. This state is shown in FIGS. 11 and 12. When the number of the supporting blocks 16 is adjusted so that the position of the fulcrum shaft is close to a rear frame 13, the chevron blade parts 55 and 45 can be arranged without being fitted in the fitting regions 44*c* and 54*c*, respectively, of the fixed blade plate 40 and moving blade plate 50 even when the moving blade plate 50 has moved forward up to the forward movement limit position Z2 toward the side of the fixed blade plate 40. Namely, a space between the tip end belt-like part 45*a* of the fixed blade plate 40 and the tip end belt-like part 55*a* of the moving blade plate 50 can also be formed, depending on the adjustment of the position of the fulcrum shaft 19, when the moving blade plate 50 has moved forward up to the forward movement limit position Z2.

Next, the chevron blade part 45 will be explained.

The chevron blade part 45 is configured in a polyhedral shape such that four deficient triangular pyramids are bound and arranged on the top surface 41*a* of the base material part 41 to be literally faulted in a chevron shape, and includes a cross-shaped tip end belt-like part 45*a* and a foot part 45*b*.

On the other hand, the foot part 45*b* is configured in a shape widening from the front side (side of the tip end belt-like part 45*a*) toward the rear side (side of the top surface 41*a* of the base material part 41). Namely, it is formed so as to become gradually higher from the front side toward the rear side.

Also, the foot part 45*b* includes a plurality of inclined belt-like parts 45*b*1 and a plurality of inclined parts 45*b*2, and the inclined parts 45*b*2 are formed from the respective inclined belt-like parts 45*b*1 toward both sides. It is configured so that one end of the respective inclined belt-like parts 45*b*1 and one end of the cross lines of the cross shape of the tip end belt-like part 45*a* are connected to each other.

An edge 43*b*3 is formed of a corner between the cross-shaped tip end belt-like part 45*a* and the foot part 45*b* (on the side of the tip end belt-like part 45*a*) and an edge 45*b*4 is formed of a corner between the respective inclined belt-like parts 45*b*1 and the foot part 45*b* (respective inclined parts 45*b*2), thereby making it possible to finely crush the material X to be crushed. In the meantime, this cross-shaped tip end belt-like part 45*a* and respective inclined belt-like parts 45*b*1 can also be a curved surface.

Figure 10:
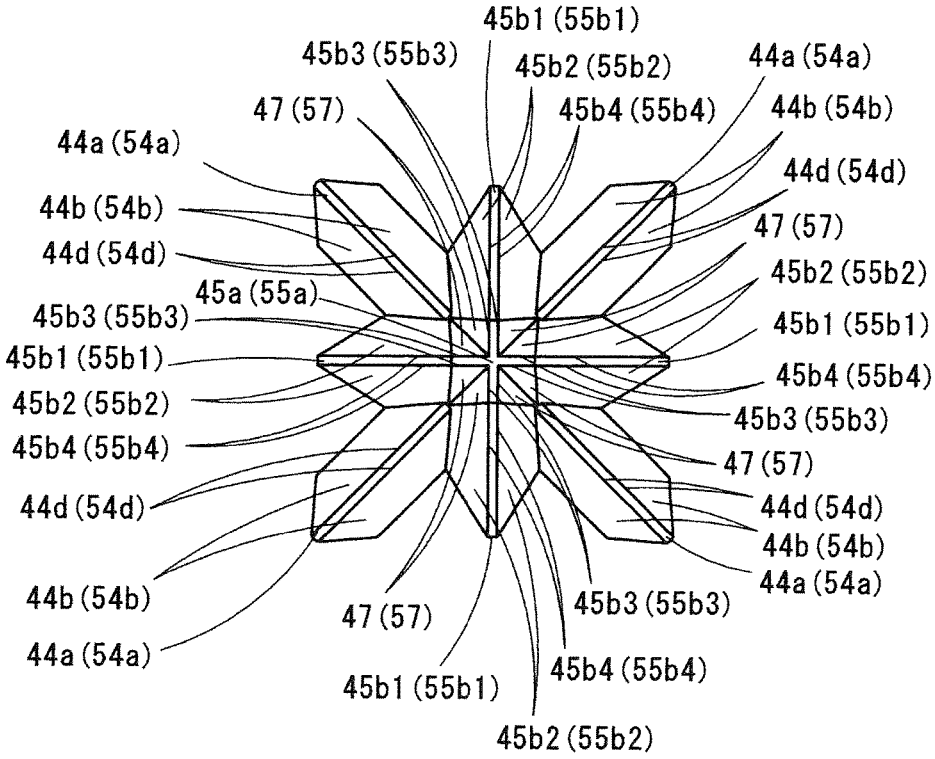
FIG. 10 is an enlarged front view of a diamond blade part and the chevron blade part.

A part of the respective inclined parts 45*b*2 of the foot part 45*b* on the side of the tip end belt-like part 45*a* has an inclined defect part 47 in order to form an edge 45*b*3. As shown in FIG. 10 and the like, this defect part 47 is configured to be inclined toward the deep side, more specifically, constitutes a substantially triangular inclined surface in a part of the respective inclined parts 45*b*2 on the side of the tip end belt-like part 45*a*. In the meantime, this defect part 47 may constitute a substantially triangular inclined surface and, in addition, may constitute, for example, a substantially square or semi-spherical inclined surface. Also, the defect part 47 may constitute a vertical surface, not an inclined surface. In short, any configuration may be employed so long as the edge 45*b*3 is formed by a notch part during crushing so that stress concentration is easily applied to the material to be crushed, resulting in more efficient crushing.

As regards the height relation between the diamond blade part 44 and the chevron blade part 45, the chevron blade part 45 is set to be higher than the diamond blade part 44. Specifically, they are arranged so that the belt-like part 44*a* of the diamond blade part 44 is located in the middle of the foot part 45*b* of the chevron blade part 45 in a side view. The numbers, sizes and the like of the diamond blade parts 44 and chevron blade parts 45 are not especially limited.

As regards the arrangement of the chevron blade parts 45 on the fixed blade plate 40, the chevron blade parts 45 can be divided into those on the upper most stage, second stage, third stage and lowermost stage as shown in FIG. 1 and the like. Since this chevron blade part 45 is arranged so as to be bound to an intersection place of the diagonal lines of the diamond blade part 44, the chevron blade parts 45 are arranged in a zig-zag manner on the base material 41. In the meantime, the chevron blade parts 45 at the left and right ends in a front view at the second stage from the top and the chevron blade parts 45 and convex blade parts 46 at the left and right ends on the lowermost stage are halved and installed, as shown in FIG. 1 and the like.

Figure 9:
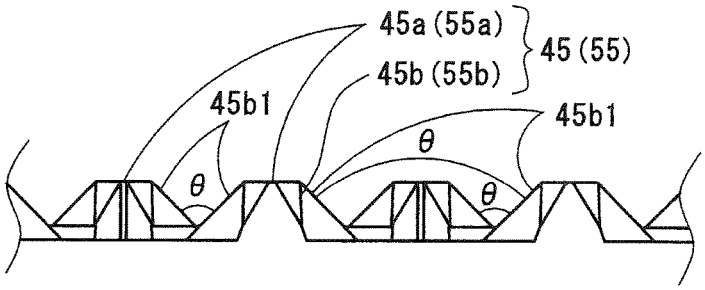
FIG. 9 is a plan view showing the relation between chevron blade parts.

Also, the angle θ between the inclined belt-like parts 45*b*1 of the chevron blade parts 45 is defined as 90° or higher as shown in FIG. 9, thereby making the material X to be crushed (crushed waste) difficult to be caught between the chevron blade parts 45 and also making the material X to be crushed (crushed waste) easy to slip down from this space between the chevron blade parts 45.

There is also an example, but not shown, wherein only a diamond blade part 44 and a chevron blade part 45 are arranged as the blade part 42, 52 of the blade plate on the fixed or moving side of the crusher Y.

Further, a convex blade part 46 is arranged in a part of the chevron blade 44 on the lowermost stage of the base material part 41 of the fixed blade plate 40. This convex blade part 46 has an edge 46*c* formed of a corner between a belt-like part 46*a* and an inclined part 46*b*, thereby making it possible to finely crush the material X to be crushed. In the meantime, this belt-like part 46*a* can also be a curved surface. This convex blade part 46 is especially effective in crushing the material X to be crushed near the discharge port of the crusher Y.

The belt-like part 44*a* of the diamond blade part 44, tip end belt-like part 45*a* and inclined belt-like part 45*b*1 of the chevron blade part 45, and belt-like part 46*a* of the convex blade part 46 desirably have a width of 5 mm to 15 mm, but may be 4 mm or less or 16 mm or more in width so long as the effects of the present invention are obtained.

Next, a holder 15 which fixes and supports the fixed blade plate 40 vertically or slantly to a frame 9, as shown in FIGS. 11 and 12, will be explained.

The holder 15 includes an upper part 15*a* and a lower part 15*b*, and the lower part 15*b* has a discharge lower end 15*b*2 extending frontward (to the side of the moving blade plate 50) and also a receiving blade 15*b*1 having an inclined surface, like a slide, from the upper side toward the lower side. The convex blade part 46 of the moving blade plate 50 moves along this inclined surface. There is a gap between the inclined surface and the convex blade part 46, and this gap is constant while the moving blade plate 50 moves from the backward movement limit position Z1 to the forward movement limit position Z2. The constant gap facilitates the discharge of the crushed material Y.

Also, any length of the extending discharge lower end 15*b*2 of the lower part 15*b* of the holder 15 may be employed. Thus, the discharge lower end 15*b*2 can also be configured so as to extend farther than that shown in FIG. 11 and the like.

The above-described holder 15 can be of a separable type in which the holder 15 can be separated into the upper part 15*a* and the lower part 15*b*, or of an integrated type in which the holder 15 cannot be separated into the upper part 15*a* and the lower part 15*b*.

When the material X to be crushed is crushed into fine pieces by the diamond blade part 44 and the chevron blade part 45, the crushed waste is discharged in such a manner that they go down the slide along the inclined surface. When the material X to be crushed is an elongated material, the elongated material X to be crushed is caught by the inclined surface like the slide, thereby making it possible to prevent the falling of the material X, to crush the material X caught by this inclined surface by means of the convex blade part 46 of the moving blade plate 50, and further to rake out and discharge this crushed waste by means of the convex blade part 46 of the moving blade plate 50.

For example, special alloy steel is employed as the material for this holder 15.

Next, the moving blade plate 50 as shown in, for example, FIGS. 5 to 8 will be explained.

A concave blade part 53 is arranged on the upper side of the base material part 51 of the moving blade plate 50. Also, there are arranged: a diamond blade part 54 provided on the lower side of this concave blade part 53 and having an edge (blade edge) 54*d* formed of a corner between a belt-like part 54*a* and an inclined part 54*b*; a chevron blade part 55 which is configured in a polyhedral shape having an edge (blade edge) 55*b*3 formed of a corner between a cross-shaped tip end belt-like part 55*a* and a foot part 55*b* and an edge (blade edge) 55*b*4 formed of a corner between an inclined belt-like part 55*b*1 and a foot part 55*b*, and which is bound to an intersection place of the diagonal lines of the diamond blade part 54; and, further, a convex blade part 56 having an edge (blade edge) 56*c* formed of a corner between a belt-like part 56*a* and an inclined part 56*b*, the convex blade part 56 being connected to a part of the chevron blade 55 arranged on the lowermost stage of the base material part 51. Small blade parts 58 including halved triangular pyramids which are vertically connected are located on both sides of this convex blade part 56. Also, this small blade part 58 may be configured so as to or so as not to have an edge (blade edge) 58*c* formed of a corner between a belt-like part 58*a* and an inclined part 58*b*.

The concave blade part 53 mainly forms a recess in the base material part 51, and is in an opening shape in which a plurality of vertical blades 53*e* and a plurality of lateral blades 53*f* are combined in a lattice shape in this recess. In the other respects, the shape, number, size and the like of the concave blade parts 53 are not especially limited, in conformity to the concave blade part 43 of the fixed blade plate 40.

The diamond blade part 54 and chevron blade part 55 of the moving blade plate 50 conform to the diamond blade part 44 and chevron blade part 45 of the fixed blade plate 40.

The convex blade part 56 includes a belt-like part 56*a* and inclined parts 56*b*, and the inclined parts 56*b* are constituted from the belt-like part 56*a* toward both sides. An edge 56*c* is formed of a corner between the belt-like part 56*a* and the inclined part 56*b*, thereby making it possible to finely crush the material X to be crushed. In the meantime, this belt-like part 56*a* can also be a curved surface.

The convex blade part 56 is curved, in a side view, as it goes downward from the upper part, and constitutes a claw part 56*d* at the lower end. The material X to be crushed can be caught by this claw part 56*d* to reliably and efficiently crush and rake out the material X.

Also, the convex blade part 56 may also be configured so as to have one or two or more notch part(s) 57 as shown in FIGS. 11 and 12. This configuration allows for further reliable and efficient crushing and raking-out of the material X. Also, the convex blade part 56 may also be configured so as not to have one or two or more notch part(s) 57 as shown, for example, in FIG. 5.

In the other respects, the convex blade part 56 conforms to the convex blade part 46 of the fixed blade plate 40.

The small blade part 58 includes a belt-like part 58*a* and inclined parts 58*b*, and the inclined parts 58*b* are constituted from the belt-like part 58*a* toward both sides. An edge 58*c* is formed of a corner between the belt-like part 58*a* and the inclined part 58*b*, thereby making it possible to finely crush the material X to be crushed. In the meantime, this belt-like part 46*a* can also be a curved surface. The small blade parts 58 may be arranged either in contact with, or not in contact with, the inclined parts 56*b*.

The small blade parts 58 are curved in a side view. In the meantime, two small blade parts 58 are provided on both sides of the respective convex blade parts 56 in FIG. 5 and the like, but one small blade part may be provided. Also, this small blade part 58 has a claw part 58*d* which allows for more reliable and efficient crushing and raking-out of the material X to be crushed.

Additionally, a blade part can be provided on the lower side of the small blade part 58 in the lateral direction and/or the vertical direction, though not shown, thereby reliably and efficiently crush and rake out the material X to be crushed.

High manganese steel is indicated as an example of the material for the base material part 41, 51 and blade part 42, 52 which constitute the blade plate according to the present invention. High manganese steel causes work hardening, which means it is successively hardened from the used portion as it is used more. Namely, it originally has low hardness, but is work-hardened from its surface, for example, by an impact applied to the surface, and is improved in abrasion resistance at a jump, leading to a great increase in lifetime of the blade plate. Specifically, the hardness of the blade plate after work hardening is HRC of 40 to 50 or more.

In the meantime, examples of the other materials for the base material part 41, 51 and blade part 42, 52 which constitute the blade plate include special steel such as carbon steel for machine structural use (SC) and alloy steel for machine structural use (SCM, etc.) and alloy casting based on ordinary cast steel FCD.

In the meantime, the same material is used for the base material part 41, 51 and blade part 42, 52 of the blade plate, so that the base material part 41, 51 and blade part 42, 52 can be treated together when the blade plate itself becomes unnecessary, thereby making the reproduction treatment easy.

A bolt hole 3 is generally formed by using a commercially-available machine tool such as a machining center (not shown). For example, a tool for processing the bolt hole 3 is attached to the main shaft of the machining center to form the bolt hole 3 upon rotation of this tool. This bolt hole 3 is fainted in at least any one of the top surface 41*a*, rear surface 41*b*, flat surface 41*c*, bottom surface 41*d* and side surface 41*e* of the base material part 41, and there can be processed the bolt hole 3 having any of M20×2.5P, M24×3.0P and M30×3.0P when the diameter of the bolt hole is designated as M (mm) and the pitch of the screw thread is designated as P (mm).

One example of the method for forming the bolt hole 3 is as follows. Here, an explanation is given for the fixed blade plate 40. First, a prepared hole is formed by drilling or the like in at least any one of the top surface 41*a*, rear surface 41*b*, flat surface 41*c*, bottom surface 41*d* and side surface 41*e* of the base material part 41 which is an attachment surface. Then, a thread groove is formed in the inner wall surface of the prepared hole by using a tap or the like, thereby processing the screw hole.

The prepared hole is formed so as to have an inner diameter smaller than the outer diameter of the thread part of the tap, and this tap is rotated and inserted through the hole, thereby cutting the inner wall surface of the prepared hole to form a bolt groove, so that the bolt hole 3 is processed. Namely, a prepared thread (prepared hole, inner diameter) having a diameter dimension smaller than that of the bolt is cut, for example, by drilling, and a bolt hole 3 is cut along the prepared thread. For example, when a tap is used to form a bolt hole 3, a hole having the prepared diameter (smallest diameter) of the bolt is formed, for example, by drilling, and the tap is screwed into this prepared hole to form the bolt hole 3.

The machining center is provided with a control device which drives and controls the driving means and main shaft of the machining center in accordance with the program for forming the bolt hole 3. Specifically, the position between the special tool for processing the bolt hole 3 and the fixed blade plate 40 moving blade plate 50, speed thereof and the like are controlled in accordance with the procedures for forming the bolt hole 3 preliminarily defined in the program for forming the bolt hole 3. The machining center performs, for example, control of the number of rotations of the main shaft, for example, by decoding the number of rotations of the main shaft motor in the program for forming the bolt hole 3.

Examples of the specific processing method include using a special tool (super-steel threading tip, etc.) attached to the main shaft, for example, of a machining center which can control three axes, i.e., X, Y and Z axes, to form a female screw hole through the use of the helical feeding (arc) function of the machining center or the like.

When this method is employed, a prepared hole is firstly formed by drilling or the like in at least any one of the top surface 41*a*, rear surface 41*b*, flat surface 41*c*, bottom surface 41*d* and side surface 41*e* of the base material part 41 which is an attachment surface.

Then, the main shaft of the machining center to which a special tool (super-steel threading tip, etc.) is attached is helically fed to the Z-axis direction while being rotated, to cut a female thread groove in the inner peripheral surface of the prepared hole. For example, a female thread groove is formed by helically feeding the main shaft, for example, so that the main shaft advances one pitch per revolution.

Also, a tap with a drill at its tip end is used so that the procedure from forming a prepared hole to threading can be performed by using one tool. Specifically, a drill tap is attached to the main shaft of the machining center to form a bolt hole 3.

The helical feeding (arc) function of the machining center or the like is utilized to process a bolt hole 3 in the fixed blade plate 40, as described above.

Figure 7:
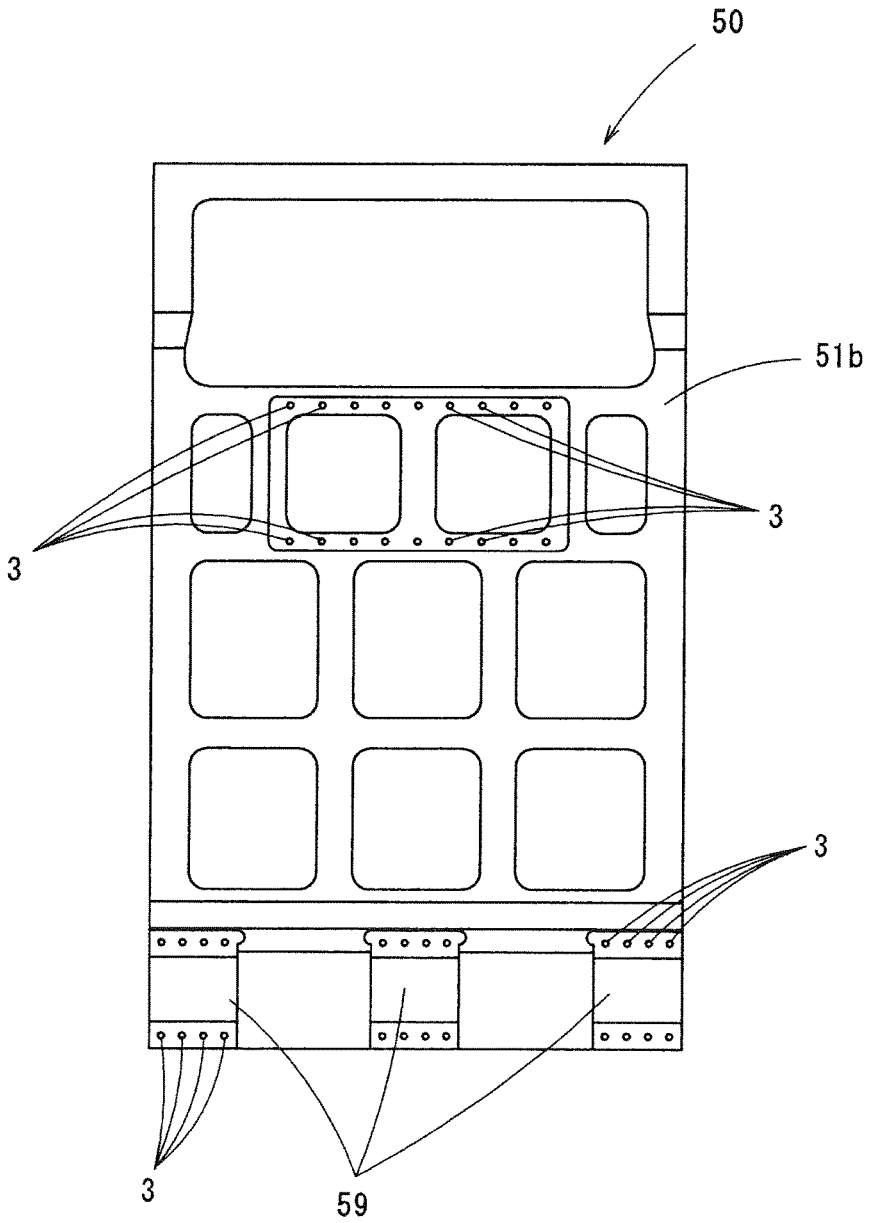
FIG. 7 is a back view of the moving blade plate.
Figure 8:
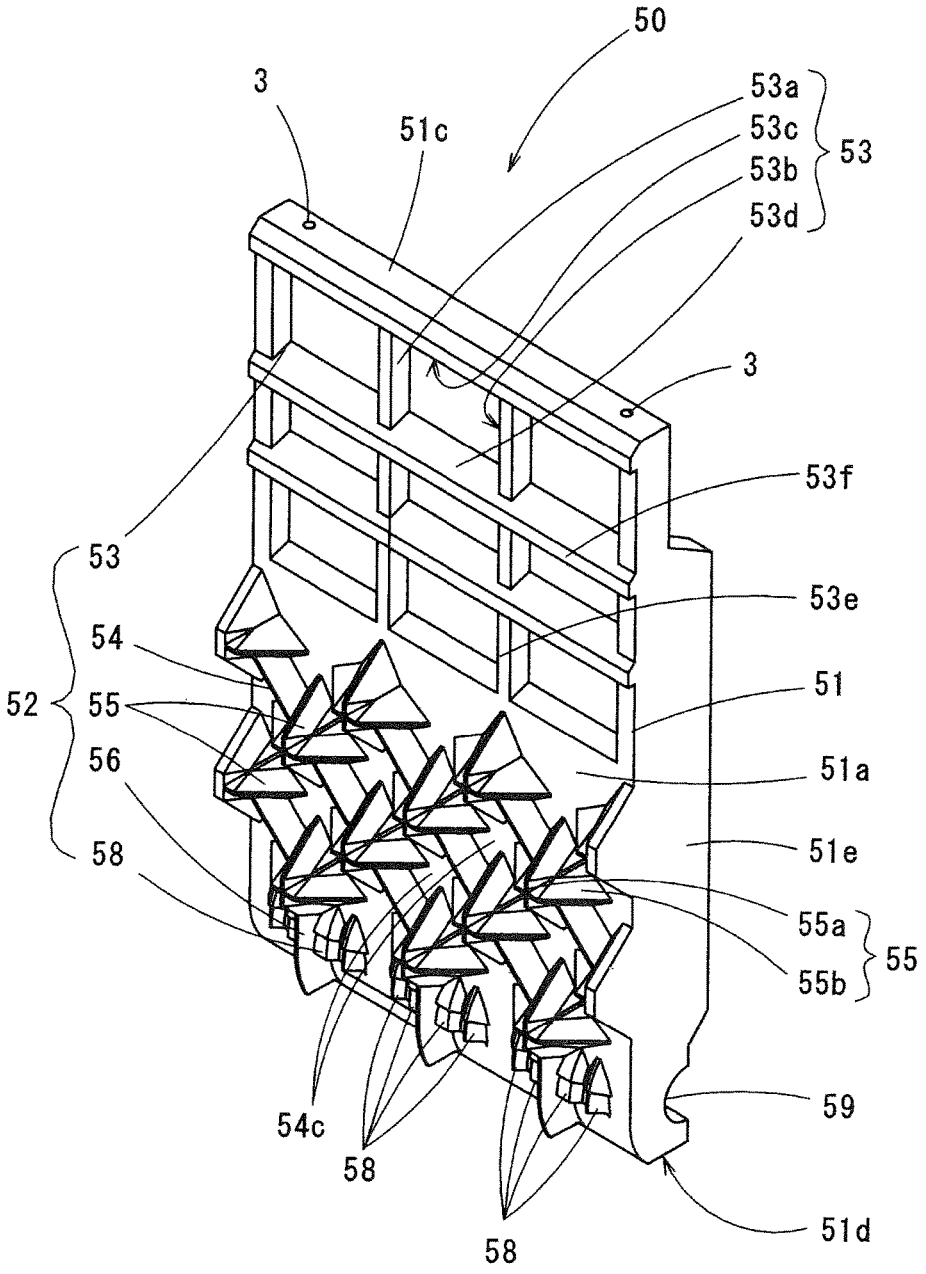
FIG. 8 is a perspective view of the moving blade plate.

A bolt hole 3 is formed also in the moving blade plate 50 in a similar method. The processing method is similar to that for the fixed blade plate 40, and thus an explanation about the method is omitted here. In FIG. 7, bolt holes 3 for fixing the blade plate on a piston rod 7 of a cylinder 6, for example, are processed.

In the meantime, the position, size, number and the like of these bolt holes 3 are not especially limited.

Concerning the fixation of the blade plate subjected to the processing of the bolt hole 3, the holder 15 is used for the fixed blade plate 40 to attach the fixed blade plate 40 to this holder 15 in FIGS. 11 and 12 as one example. Specifically, a concave or convex part is formed on a surface of the holder 15 provided on the frame 9 of the crusher Y, the surface being intended for mounting the fixed blade plate 40, whereas a convex or concave part is formed on a surface of the fixed blade plate 40 for mounting the holder 15. The concave or convex part formed on the surface of the holder 15 for mounting the fixed blade plate 40 and the convex or concave part formed on the surface of the fixed blade plate 40 for mounting the holder 15 are fitted, and bolts or the like are inserted from the side of the holder 15 through the bolt holes 3 formed in the holder 15 and fixed blade plate 40 to attach the fixed blade plate 40 to the holder 15.

Conventional moving blade plates 50 employed a holder 15 as with the fixed blade plate 40 described above, and the moving blade plate 50 was attached to this holder 15. For example, a concave or convex part was formed on a surface of the holder 15 for mounting the moving blade plate 50, whereas a convex or concave part was formed on a surface of the moving blade plate 50 for mounting the holder 15. The concave or convex part formed on the surface of the holder 15 for mounting the moving blade plate 50 and the convex or concave part formed on the surface of the moving blade plate 50 for mounting the holder 15 were fitted, and bolts or the like were inserted from the side of the holder 50 through the bolt holes 3 formed in the holder 15 and moving blade plate 50 to attach the moving blade plate 50 to the holder 15. In FIGS. 11 and 12, a piston rod of a cylinder is fixed on the upper part of the back surface of the moving blade plate 50 without using a holder 15 for the moving blade plate 50. Since the piston rod is fixed on the upper side of the back surface of the moving blade plate 50 in this manner, the moving blade plate 50 can be moved forward and backward with less power.

In the meantime, the case where the holder 15 is provided for the fixed blade plate 40 and the moving blade plate 50, respectively, and the case where no holder 15 is provided for the fixed blade plate 40 or the moving blade plate 50 are also conceivable as any other examples, as long as the effect of the invention is provided. Further, a fixed blade plate 40 which also exhibits the function of the holder 15, i.e., a fixed blade plate which also serves as a holder can also be used.

When this holder 15 for attaching a blade (blade plate) is not used, the cost of the blade plate as a product can be reduced, and the measures to reduce its weight are made easy, thereby making it possible to suppress the total weight of the crusher Y.

The fixed blade plate 40 and moving blade plate 50 are attached/detached via a bolt in this manner, and thus can be singly and easily replaced.

Desirably, the bolt is made of high carbon steel and corresponds to high load/high torque.

The blade plate of the present invention is useful mainly for hard-to-crush (hard-to-cut, hard-to-break) materials having properties of, for example, being hard and thick, such as ductile cast iron (FCD material), but is also useful in crushing (cutting, breaking) gray (ordinary) cast iron (FC material).

Next, one example of the configuration of a crusher Y wherein the fixed blade plate 40 and moving blade plate 50 are mounted will be explained.

The crusher Y includes, as main components: a vertically-opening frame 9 which is composed of a pair of side frames 10 and 11 provided in juxtaposition, a front frame 12 connecting the front sides of both the side frames 10 and 11 and a rear frame 13 connecting the rear sides of both the side frames 10 and 11, and which has an upper opening part 9*a* for injecting a material X to be crushed and a lower opening part 9*b* for discharging the crushed waste; a fixed blade plate 40 which is fixed and supported on a holder 15 provided vertically or slantly to the frame 9; and a moving blade plate 50 which is axially supported on a fulcrum shaft 19 constructed between both the side frames 10 and 11, is inclined to the frame at a backward movement limit position Z1, becomes vertical to the frame 9 at a forward movement limit position Z2, and moves forward and backward using the fulcrum shaft 19 as a fulcrum in accordance with the forward and backward movement of the piston rod 7 of a cylinder 6 provided on the rear frame 13. The material X to be crushed is supplied to a V-shaped crushing space formed between the fixed blade plate 40 and the moving blade plate 50, and is crushed upon forward movement of the moving blade plate 50 to the fixed blade plate 40.

In the meantime, as described above, the moving blade plate 50 is axially supported on a fulcrum shaft 19 constructed between both the side frames 10 and 11, and, specifically, axially supported on the fulcrum shaft 19 by a semi-circular axial supporting part 59 formed on the lower side of the moving blade plate 50. The fulcrum shaft 19 is covered with a fulcrum shaft cap (not shown) and fixed on the moving blade plate 50 by means of a fixing tool such as a bolt.

Also, the fulcrum shaft 19 is mainly supported through the use of a bearing, frame holes widely opened in both the side frames 10 and 11 and supporting blocks 16 fitted in these frame holes. Thus, the numbers of the left and right supporting blocks 16 can be controlled in the frame holes by utilizing the extraction/insertion of the supporting blocks 16 fitted in the frame holes, thereby changing the position of the fulcrum shaft 19. Namely, it is possible to adjust the crushing space V formed between the fixed blade plate 40 and the moving blade plate 50 when the moving blade plate 50 reaches a forward movement limit position Z2.

Also, examples of any other configuration which changes the position of the fulcrum shaft 19 include a configuration (not shown) using a bearing, a metal internally mounted on the bearing, an eccentric bush, and a stopper for fixing and stopping the eccentric bush on the bearing. According to this configuration, the stopper such as a bolt is removed; the eccentric bush is rotated and moved; the position of the fulcrum shaft 19 is changed; and the eccentric bush is fixed by the stopper such as a bolt after the change of this eccentric bush, and fixed and stopped. The position of the fulcrum shaft 19 can be changed to fix it in this manner.

The convex blade part 56 and small blade part 58 arranged on the base material part 51 of the moving blade plate 50 are located near the fulcrum shaft 19, as shown in FIG. 12 and the like.

Also, X is a distance from the center of the fulcrum shaft 19 to the piston rod 7 in FIG. 12. Y is a distance from the center of the fulcrum shaft 19 to the lower side of the top surface 51*a* of the moving blade plate 50. The distance X is made four to six times longer than the distance Y based on the principle of leverage. Therefore, even heavy and hard materials to be crushed can be crushed with less power.

When the holder 15 for fixing the fixed blade plate 40 is provided slantly to the frame 9, the fixed blade plate 40, which is fixed and supported on this holder 15, is also arranged slantly to the frame 9. When the fixed blade plate 40 is arranged slantly to the frame 9 in this manner and the moving blade plate 50 is also located at the backward movement limit position Z1, the V-shaped crushing space V formed between the fixed blade plate 40 and the moving blade plate 50 can be widely formed, so that relatively large materials X to be crushed can be injected.

Also, when the holder 15 fixing the fixed blade plate 40 is provided vertically to the frame 9, the fixed blade plate 40, which is fixed and supported on this holder 15, is also arranged vertically to the frame 9. When the fixed blade plate 40 is arranged vertically to the frame 9 in this manner, the V-shaped crushing space V formed between the fixed blade plate 40 and the moving blade plate 50 is narrow as compared with the case where the fixed blade plate 40 is inclined. However, when the moving blade plate 50 has come to the forward movement limit position Z2, the moving blade plate 50 and fixed blade plate 40 are opposed longitudinally and substantially horizontally, so that the crushing space formed between the fixed blade plate 40 and the moving blade plate 50 is narrow. Therefore, the material X to be crushed can be more finely crushed.

FIG. 11 shows a trunnion type as a method for mounting the cylinder 6, but any other method may be employed. A fluid cylinder using oil pressure or air pressure as a working fluid can also be used as this cylinder 6. For example, in the case of a hydraulic cylinder device, there is employed a linear feed driving mechanism of moving the piston rod 7 forward and backward to crush the material to be crushed which has been injected between the fixed blade plate 40 and the moving blade plate 50. Therefore, the moving blade plate 50 is gradually displaced by the linear feed driving mechanism of the hydraulic cylinder, thereby allowing the strong oil pressure to act on the material X to be crushed to crush the material X.

The cylinder 6 is provided with a trunnion on the side of the piston rod 7, and is rotatably supported to the rear frame 13 by a trunnion bearing via a trunnion shaft.

A clevis bearing is provided at the tip end of the piston rod 7, and a cylinder bracket is turnably pivoted via a clevis shaft. The attachment surface of this cylinder bracket is attached to a predetermined position where the bolt hole 3 processing has been applied on the upper side of the rear surface of the moving blade plate 50.

The cylinder bracket pivoted onto the piston rod 7 is mounted on the upper side of the rear surface 51*b* of the moving blade plate 50, and the moving blade plate 50 moves forward and backward using the fulcrum shaft 19 as a fulcrum upon expansion/contraction of the piston rod 7. This forward and backward movement utilizes the principle of leverage using the fulcrum shaft 19 as a fulcrum, and can suppress the output of the cylinder 6 and move the moving blade plate 50 with relatively small motive power.

One or a plurality of liner(s) can also be attachably/detachably provided on the insides of both the side frames 10 and 11 by means of a stopper such as a bolt. Also, it is possible to employ a configuration such that the head of the stopper such as a bolt is machined to be substantially flush with the liner(s) by means of a polishing means.

This liner employs, for example, a high-hardness material, such as cemented carbide, having abrasion resistance, and is provided on both the side frames 10 and 11, thereby making it possible to avoid impacts on both the side frames 10 and 11 caused by the material X to be crushed. Therefore, it is possible to improve the durability of both the side frames 10 and 11 and to prolong their lifetime. Also, the friction between both the side frames 10 and 11 and the blade plate can be avoided. In the meantime, the hardness of this liner is, for example, HRC of about 50 to 60.

EXPLANATION OF REFERENCE NUMERALS

3. Bolt hole
6. Cylinder
7. Piston rod
9. Frame
9*a*. Upper opening part
9*b*. Lower opening part
10. Side frame
11. Side frame
12. Front frame
13. Rear frame
15. Holder
15*a*. Upper part
15*b*. Lower part
15*b*1. Receiving blade
15*b*2. Discharge lower end
16. Supporting block
17. Fulcrum shaft
40. Fixed blade plate
41. Base material part
41*a*. Top surface
41*b*. Rear surface
41*c*. Flat surface
41*d*. Bottom surface
41*e*. Side surface
42. Blade part
43. Concave blade part
43*a*. Left inner surface
43*b*. Right inner surface
43*c*. Upper inner surface
43*d*. Lower inner surface
43*e*. Vertical blade
43*f*. Lateral blade
44. Diamond blade part
44*a*. Belt-like part
44*b*. Inclined part
44*c*. Fitting region
44*d*. Edge
45. Chevron blade part
45*a*. Tip end belt-like part
45*b*. Foot part
45*b*1. Inclined belt-like part
45*b*2. Inclined part
45*b*3. Edge
45*b*4. Edge
46. Convex blade part
46*a*. Belt-like part
46*b*. Inclined part
46*c*. Edge
47. Defect part
50. Moving blade plate
51. Base material part
51*a*. Top surface
51*b*. Rear surface
51*c*. Flat surface
51*d*. Bottom surface
51*e*. Side surface
52. Blade part
53. Concave blade part
53*a*. Left inner surface

53*b*. Right inner surface
53*c*. Upper inner surface
53*d*. Lower inner surface
53*e*. Vertical blade
53*f*. Lateral blade
54. Diamond blade part
54*a*. Belt-like part
54*b*. Inclined part
54*c*. Fitting region
54*d*. Edge
55. Chevron blade part
55*a*. Tip end belt-like part
55*b*. Foot part
55*b*1. Inclined belt-like part
55*b*2. Inclined part
55*b*3. Edge
55*b*4. Edge
56. Convex blade part
56*a*. Belt-like part
56*b*. Inclined part
56*c*. Edge
56*d*. Claw part
57. Notch part
58. Small blade part
58*a*. Belt-like part
58*b*. Inclined part
58*c*. Edge
58*d*. Claw part
59. Axial supporting part
V. Crushing space
X. Material to be crushed
Y. Crusher
Z1. Backward movement limit position
Z2. forward movement limit position

The invention claimed is:

1. A blade plate for crushers to be installed on a fixed side or a moving side, comprising a base material part and a plurality of blade parts arranged on a surface of the base material part, wherein the blade part comprises:

a diamond blade part having an edge formed of a corner between a belt part and an inclined part; and a chevron blade part which is configured in a polyhedral shape having an edge formed of a corner between a cross-shaped tip end belt part and a foot part and an edge formed of a corner between an inclined belt part and a foot part, and which is bound to an intersection place of diagonal lines of the diamond blade part.

2. The blade plate for crushers to be installed on a fixed side or a moving side according to claim 1, wherein materials for the base material part and the blade parts are high manganese cast steel, and wherein at least any one of a top surface, rear surface, flat surface, bottom surface and side surface of the base material part is provided with a bolt hole through which a bolt is screwed and inserted.

3. The blade plate for crushers to be installed on a fixed side or a moving side according to claim 1, wherein the belt part of the diamond blade part, the tip end belt part and the inclined belt part of the chevron blade part, the belt part of the convex blade part and the belt part of the small blade parts have a width of 5 mm to 15 mm.

4. The blade plate for crushers to be installed on a fixed side or a moving side according to claim 1, wherein an angle between the inclined belt parts of the chevron parts arranged on the base material part is 90 or higher.

5. A blade plate for crushers to be installed on a fixed side, comprising a base material part and a plurality of blade parts arranged on a surface of the base material part, wherein the blade part comprises:

a concave blade part arranged on an upper side of the base material part;

a diamond blade part arranged on a lower side of the concave blade part and having an edge formed of a corner between a belt part and an inclined part;

a chevron blade part which is configured in a polyhedral shape having an edge formed of a corner between a cross-shaped tip end belt part and a foot part and an edge formed of a corner between an inclined belt part and a foot part, and which is bound to an intersection place of diagonal lines of the diamond blade part; and a convex blade part having an edge formed of a corner between a belt part and an inclined part, the convex blade part being connected to a part of the chevron blade arranged on the lowermost stage of the base material part.

6. The blade plate for crushers to be installed on a fixed side according to claim 5, wherein the concave blade part forms a recess in the base material part, and is formed in an opening shape such that a vertical blade and a lateral blade are combined in the recess, and wherein a left inner surface, right inner surface and lower inner surface of the concave blade part are inclined toward a deep side so that the upper inner surface is vertical to the base material part.

7. A blade plate for crushers to be installed on a moving side, comprising a base material part and a plurality of blade parts arranged on a surface of the base material part, wherein the blade part comprises:

a concave blade part arranged on an upper side of the base material part;

a diamond blade part arranged on a lower side of the concave blade part and having an edge formed of a corner between a belt part and an inclined part;

a chevron blade part which is configured in a polyhedral shape having an edge formed of a corner between a cross-shaped tip end belt part and a foot part and an edge formed of a corner between an inclined belt part and a foot part, and which is bound to an intersection place of diagonal lines of the diamond blade part;

a convex blade part having an edge formed of a corner between a belt part and an inclined part, the convex blade part being connected to a part of the chevron blade arranged on a lowermost stage of the base material part, and halved triangular pyramid blade parts which are vertically connected, the halved triangular pyramid blade parts being located on both sides of the convex blade part.

8. The blade plate for crushers to be installed on a moving side according to claim 7, wherein the halved triangular pyramid blade parts have an edge formed of a corner between a belt part and an inclined part.

9. The blade plate for crushers to be installed on a moving side according to claim 7, wherein the concave blade part forms a recess in the base material part, and is in an opening shape in which a vertical blade and a lateral blade are combined in a lattice shape in the recess, and wherein a left inner surface, right inner surface and lower inner surface of the concave blade part are inclined toward a deep side so that the upper inner surface is vertical to the base material part.

10. The blade plate for crushers to be installed on a moving side according to claim 7, wherein the convex blade part has one or two or more notch part(s).

11. A crusher comprising:

a vertically-opening frame which is composed of a pair of side frames provided in juxtaposition, a front frame connecting front sides of both the side frames and a rear frame connecting rear sides of both the side frames, and which has an upper opening part for injecting a material to be crushed and a lower opening part for discharging the crushed material;

a fixed blade plate which is fixed and supported on a holder provided vertically or slantly to the frame; and a moving blade plate which is axially supported on a fulcrum shaft constructed between both the side frames, is inclined to the frame at a backward movement limit position, becomes vertical to the frame at a forward movement limit position, and moves forward and backward using the fulcrum shaft as a fulcrum in accordance with the forward and backward movement of a piston rod of a cylinder provided on the rear frame, wherein the material to be crushed is supplied to a V-shaped crushing space formed between the fixed blade plate and the moving blade plate, and is crushed upon forward movement of the moving blade plate to the fixed blade plate, wherein one or both of the fixed blade plate and the moving blade plate further comprise a diamond blade part having an edge formed of a corner between a belt part and an inclined part; and a chevron blade part which is configured in a polyhedral shape having an edge formed of a corner between a cross-shaped tip end belt part and a foot part and an edge formed of a corner between an inclined belt part and a foot part, and which is bound to an intersection place of diagonal lines of the diamond blade part.

12. The crusher according to claim 11, wherein both the side frames further comprise a liner having abrasion resistance on the inside thereof.

13. The crusher according to claim 11, wherein the holder comprises an upper part and a lower part, and the lower part has a discharge lower end extending frontward and also a receiving blade having an inclined surface from the upper side toward the lower side.

14. A crusher comprising:

a vertically-opening frame which is composed of a pair of side frames provided in juxtaposition, a front frame connecting front sides of both the side frames and a rear frame connecting the rear sides of both the side frames, and which has an upper opening part for injecting a material to be crushed and a lower opening part for discharging the crushed material;

a fixed blade plate which is fixed and supported on a holder provided vertically or scantly to the frame; and a moving blade plate which is axially supported on a fulcrum shaft constructed between both the side frames, is inclined to the frame at a backward movement limit position, becomes vertical to the frame at a forward movement limit position, and moves forward and backward using the fulcrum shaft as a fulcrum in accordance with the forward and backward movement of a piston rod of a cylinder provided on the rear frame, wherein the material to be crushed is supplied to a V-shaped crushing space formed between the fixed blade plate and the moving blade plate, and is crushed upon forward movement of the moving blade plate to the fixed blade plate, wherein the fixed blade plate further comprises a concave blade part arranged on an upper side of the base material part;

a diamond blade part arranged on a lower side of the concave blade part and having an edge formed of a corner between a belt part and an inclined part;

a chevron blade part which is configured in a polyhedral shape having an edge formed of a corner between a cross-shaped tip end belt part and a foot part and an edge formed of a corner between an inclined belt part and a foot part, and which is bound to an intersection place of diagonal lines of the diamond blade part; and a convex blade part having an edge formed of a corner between a belt part and an inclined part, the convex blade part being connected to a part of the chevron blade arranged on the lowermost stage of the base material part, and wherein the moving blade plate comprises a base material part and a plurality of blade parts arranged on a surface of the base material part, the moving blade part further comprising a concave blade part arranged on an upper side of the base material part;

a diamond blade part arranged on a lower side of the concave blade part and having an edge formed of a corner between a belt part and an inclined part;

a chevron blade part which is configured in a polyhedral shape having an edge formed of a corner between a cross-shaped tip end belt part and a foot part and an edge formed of a corner between an inclined belt part and a foot part, and which is bound to an intersection place of diagonal lines of the diamond blade part;

a convex blade part having an edge formed of a corner between a belt part and an inclined part, the convex blade part being connected to a part of the chevron blade arranged on a lowermost stage of the base material part, and halved triangular pyramid blade parts which are vertically connected, the halved triangular pyramid blade parts being located on both sides of this convex blade part is used as the moving blade plate.

* * * * *